US005290607A

United States Patent [19]

Chitouras

[11] Patent Number: 5,290,607

[45] Date of Patent: Mar. 1, 1994

[54] METHOD AND SYSTEM FOR SIGNIFICANTLY INCREASING THE DENSITY OF PARTICULATES ON A SUBSTRATE

[76] Inventor: Costa G. Chitouras, 10 Packard Ave., Somerville, Mass. 02144

[21] Appl. No.: 844,108

[22] Filed: Mar. 2, 1992

[51] Int. Cl.[5] ..... B05D 1/06; B05B 5/00

[52] U.S. Cl. ..... 427/462; 427/171; 427/202; 427/206; 427/270; 118/33; 118/308; 118/621; 264/131

[58] Field of Search ..... 427/27, 171, 172, 173, 427/174, 206, 270, 275, 294, 430.1, 202, 462, 463, 464, 465, 475; 118/33, 34, 308, 416, 621; 264/112, 131, 510, 511, 512; 425/100, 308; 156/279; 428/90

[56] References Cited

U.S. PATENT DOCUMENTS

| | | | |
|---|---|---|---|
| 1,922,020 | 8/1933 | Van Voorhis | 427/174 |
| 2,792,323 | 5/1957 | Ashcroft et al. | 427/174 |
| 3,385,264 | 5/1968 | Heyl et al. | 118/621 |
| 3,797,996 | 3/1974 | Gregorian et al. | 8/114.5 |
| 3,936,554 | 2/9176 | Squier | 428/90 |
| 4,579,763 | 4/1986 | Mitman | 428/95 |
| 4,761,309 | 8/1988 | Embry | 427/294 |

FOREIGN PATENT DOCUMENTS

| | | | |
|---|---|---|---|
| 733078 | 3/1943 | Fed. Rep. of Germany . | |
| 46-19558 | 6/1971 | Japan | 264/131 |
| 61-179382 | 8/1986 | Japan . | |

*Primary Examiner*—Terry J. Owens

*Attorney, Agent, or Firm*—Hamilton, Brook, Smith & Reynolds

[57] ABSTRACT

A method and system for significantly increasing the density of particulates on a substrate includes disposing a particulate material, such as fibers or abrasive material, onto a surface of the substrate, whereby the particles adhere to the substrate. The substrate is then exposed to conditions sufficient to cause the surface area, on which the particulate material is disposed, to diminish, thereby significantly increasing the density of the particulate material. The system includes a support on which the substrate is disposed, apparatus for disposing the particulate material in the substrate and apparatus for causing the surface on which the particulate material is disposed to significantly diminish.

16 Claims, 5 Drawing Sheets

METHOD AND SYSTEM FOR SIGNIFICANTLY INCREASING THE DENSITY OF PARTICULATES ON A SUBSTRATE

BACKGROUND OF THE INVENTION

Many products include a substrate which are coated with a particulate substance, such as fibers or granules adhering to a surface of the substrate. For example, common forms of such fibers are often referred to as flock, whereas particles, in general, may be abrasive particles, such as are used in sandpaper. Because flock usually has the largest length-to-width ratio of commonly applied particulate materials and is usually made of flexible materials, with a typical length between about thirty and eighty mils and a denier of between about one and eighteen denier, it is usually the most difficult particulate substance to deposit at high density levels.

With regard to flocked products, for example, the highest density of fibers on commercially available products, generally do not exceed about four ounces of flock per square yard. It is rarely possible to exceed about fifteen or so percent of the theoretical flock density possible for a given flock length and denier, i.e. where maximum theoretical flock density on the surface exists when the substrate is essentially packed with straight fibers, each fiber touching adjacent fibers along its whole length.

There are several problems associated with limited particulate density. For example, multiple applications of a weight or a frictional shuffling action, as on a flocked carpet, or on any of the commonly available carpet structures, often bends the fibers at the base where the fibers enter the adhesive layer or base structure, tending to break the fibers without actually abrading or wearing them away throughout their lengths.

In contrast, the same weight or shuffling action on a high-density surface bends the fibers, but not at their bases, since the close proximity of adjacent fibers "support" each other, causing the weight or abrasive force to wear the top ends of the fibers, allowing the whole length of the fibers to wear, thus presenting a great deal of material to resist the abrading action. However, an increase in the density of flock on a flocked surface will result in a substantially greater increase in the resistance of the flocked surface to abrasion than the increase of flock density would normally indicate. Hence, even the highest density flocked substrates commonly available generally do not offer adequate abrasion resistant surfaces for use in many applications.

In another embodiment, the utility of filters having flocked components is also limited by the density and arrangement of fibers of the flock. For example, a relatively low density of fibers can significantly diminish the efficiency of filtration. Also, flock is generally uniformly distributed on substrates, thereby limiting, for example, the design of filters or the esthetic design of automobile cabin interiors which employ flocked components.

Therefore, there is a need for a method of significantly increasing or varying the density of a particulate substance adhering to a substrate and for articles which are formed by such a method.

SUMMARY OF THE INVENTION

The present invention relates to a method for significantly increasing the density of a particulate substance adhering to a substrate. The invention also relates to articles which are formed by such a method.

The method includes disposing a particulate substance onto a substrate, which, during exposure of the substrate to sufficient conditions, significantly diminishes in surface area. The substrate is then exposed to conditions sufficient to significantly diminish the surface area of the substrate, thereby significantly increasing the density of the particulate substance on the substrate.

The system includes means for disposing the particulate substance onto a substrate which, during exposure of the substrate to sufficient conditions, significantly diminishes in surface area, the particulate substance adhering to the substrate. Suitable means expose the substrate to conditions sufficient to significantly diminish the surface area of the substrate, thereby significantly increasing the density of the particulate substance on the substrate.

This invention has many advantages. For example, the density of a particulate material, such as flock, can be significantly increased over the density of the material as it is disposed onto the substrate. Also, the method can include distention of a substantially resilient substrate, whereby the surface area of the substrate can be significantly diminished by allowing the substrate to assume a relaxed position. Further, the substrate can be distended asymmetrically, whereby a continuous gradient of particulate density can be formed on the substrate when the substrate is allowed to relax, thereby causing the substrate surface to significantly diminish. In addition, articles, such as filters, can be formed which include flocked substrates having continuous gradients of flock density across surfaces of substrate components of the filter.

It is not always necessary that the total surface of a product have a higher flock density than can be attained by an otherwise high-quality flocking operation. Specifically, one may desire that certain portions of a flocked substrate have higher density than other portions, either for increased abrasion resistance, esthetics, tactile qualities or clean ability, to name a few possible reasons. Expansion of the principles and teachings described in the above example of covering a tennis ball may be used to make possible normal, as well as high-density flocking, on the same item, that is, providing a variable density of flock deposition on a single substrate.

Variation of flock density could be desirable, for example, in a door panel liner, inasmuch as it would concentrate the highest density flocked portions where there is maximum wear and abrasion, namely, at the handpull and the kickplate regions of a car door. Subsequently, the flocked membrane can be assembled to a suitable substrate, as, for example, a molded plastic door panel.

Another application of this invention, beneficially utilizing both the characteristics of high density and variable density flocking, is the production of a high performance air or other, general purpose, fluid filter. Such a filter would be designed to remove the larger particles at the input side, i.e. have relatively large openings to trap the larger particles and allow smaller particles to penetrate this initial surface area but be trapped further inside a more dense filter area, having progressively smaller openings. Such a design provides a low resistance to the flow of air or other fluids while removing the majority of particles, from large to small, and retaining a low-clog, long-life filter design by not requiring the input side of the filter to consist of small cell structures to capture all the particles, whether large or small. Depending on the distribution of the size of the contaminants in the fluid, the filter density may be designed to maximize the lifetime of the filter by adjusting the filter density profile to match the expected contaminant profile, so that the whole filter, more or less, reaches its contaminated saturation level at approximately the same time.

DETAILED DESCRIPTION OF THE INVENTION

The above features and other details of the method and apparatus of the invention will now be more particularly described with reference to the accompanying drawings and pointed out in the claims. The same number present in different figures represents the same item. It will be understood that the particular embodiments of the invention are shown by way of illustration and not as limitations of the invention. The principle features of this invention can be employed in various embodiments without departing from the scope of the invention.

Figure 1:
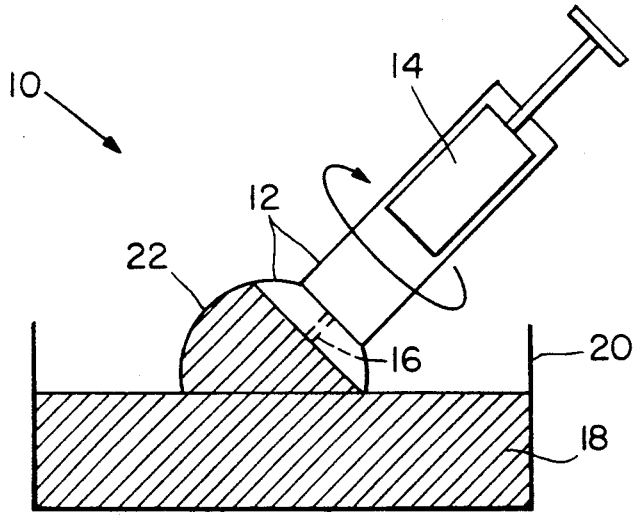
FIG. 1 is a schematic illustration of one embodiment of the invention, including a rotating mandrel and plunger partially immersed in a liquid latex bath.

In one embodiment of the present invention, system 10, shown in FIG. 1, includes mandrel 12, which incorporates inflation/suction plunger 14 and defines conduit 16. Mandrel 12 is partially immersed in liquid latex bath 18, which is contained in trough 20. An example of a suitable latex is VULTEX 1-V-10, a polyisoprene compound, commercially available from General Latex and Chemical Corp. Mandrel 12 is slowly rotated so that liquid latex layer 22 is deposited onto mandrel 12.

Figure 2:
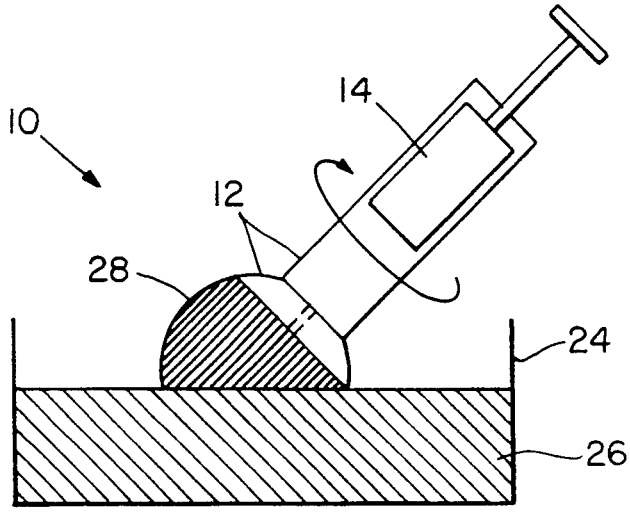
FIG. 2 is a schematic illustration of the embodiment illustrated in FIG. 1, wherein the mandrel is immersed in a coagulant for liquid latex.

Mandrel 12, with liquid latex layer 22 disposed thereon, is transported to trough 24, shown in FIG. 2, containing coagulant 26. An example of a suitable coagulant is a calcium nitrate solution. Rotating mandrel 12 causes all of the liquid latex to contact coagulant 26 and become thin rubber substrate 28, which remains attached to mandrel 16 when removed from the coagulant. The thickness of the substrate can be controlled by any of several techniques, such as by varying the viscosity and solids content of the liquid latex, or by varying the number of times the mandrel is dipped into the latex and coagulated.

Figure 3:
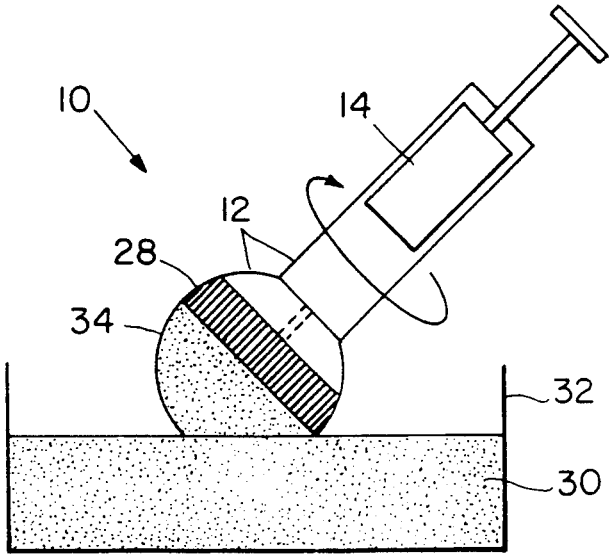
FIG. 3 is a schematic illustration of the embodiment illustrated in FIG. 1, wherein the mandrel and rubber substrate are immersed in a liquid flock adhesive.

As can be seen in FIG. 3, substrate 28, which surrounds a greater than hemispheric section of mandrel 12, is immersed in liquid adhesive 30 in trough 32. Immersion of substrate 28 is only as deep into liquid adhesive 30 as necessary to insure that slightly more than a hemispheric portion of substrate 28 is coated. Mandrel 12 is rotated to ensure a substantially even, thin distribution of adhesive coating 34, with the thickness of adhesive deposited onto substrate 28 being controlled by such variables as viscosity and solids content of liquid adhesive 30. The desired thickness of adhesive coating 34 is suitable for a selected application, such as the desired thickness of a flock of the fibers. In one embodiment, the thickness of the adhesive coating is about a few mils.

Figure 4:
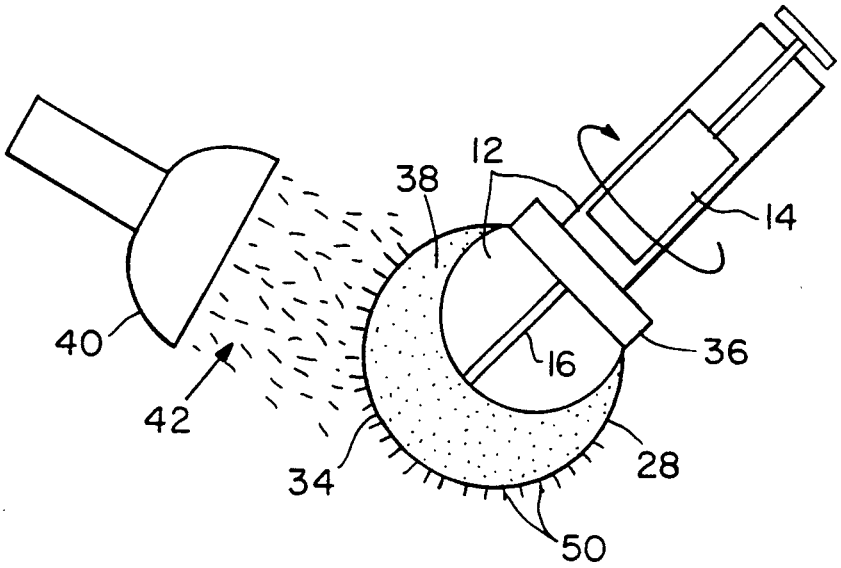
FIG. 4 is a schematic illustration of the embodiment illustrated in FIG. 3, further including a clamp applied around the rubber substrate, which is in a distended position, and an electrostatic flocking means.

Mandrel 12 is then removed from the adhesive and clamp 36 is placed around the portion of substrate 28 which has not been wetted with adhesive, as can be seen in FIG. 4. A suitable material, such as a gas, is directed through conduit 16 by plunger 14 and between mandrel 12 and substrate 28, thereby distending substrate 28. An example of a suitable gas is air. It is to be understood, however, that other materials can be disposed between mandrel 12 and substrate 28, such as a liquid. An example of a suitable liquid is water. Gas 38, disposed between mandrel 12 and substrate 28, causes substrate 28 to be distended, thereby causing substrate 28 to significantly increase in surface area.

Distended substrate 28, having adhesive coating 34 disposed thereon, is rotated adjacent to flock dispenser 40, which includes a suitable high voltage power supply, for example, to charge the flock so as to propel flock 42 towards adhesive layer 34.

Figure 5:
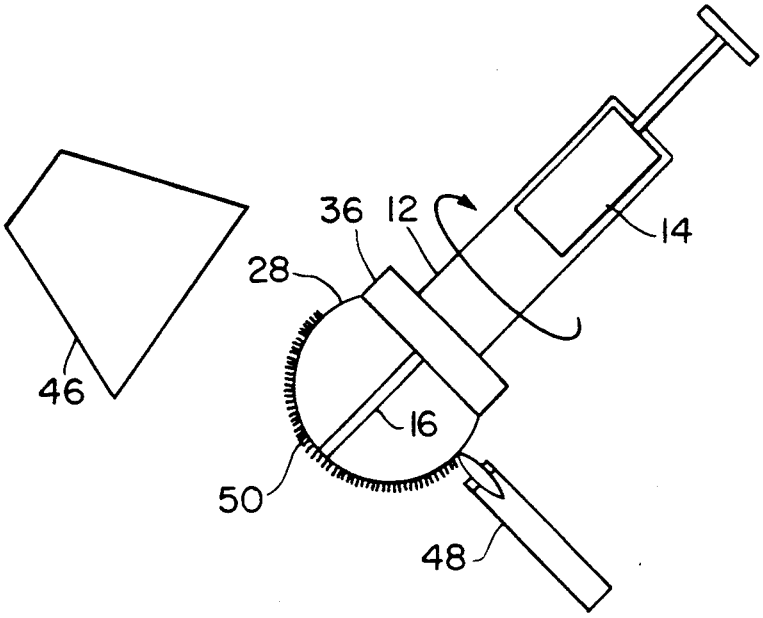
FIG. 5 is a schematic illustration of the embodiment illustrated in FIG. 4, after release of the air pressure, whereby the flocked rubber substrate has returned to a relaxed position, together with a cutoff tool.

Typically, after a few seconds of disposing flock 42 onto adhesive coating 34, such as when no more flock can adhere to adhesive coating 34, mandrel 12 and all the attached components are removed from the vicinity of flock dispenser 40 and gas 38 is released from between mandrel 12 and substrate 28 via conduit 16. In one embodiment, a slight vacuum is created in conduit 16 by pulling plunger 14 to its furthest retracted position, thereby causing substrate 28 to contract to its original size. Substrate 28 significantly diminishes in surfaces area, as shown in FIG. 5, thereby significantly increasing the density of flock on substrate 28.

Mandrel 12 is then disposed in drying chamber 46 for curing the adhesive by a suitable method. After such cure, knife blade 48 is brought in contact with mandrel 12, cutting through the flock layer 50, adhesive coating 4 (now cured), and substrate 28 at about the "hemisphere" line. Substrate 28 is then removed from mandrel 12 by reapplying pressure via plunger 14 and conduit 16 to the hemisphere, popping off substrate 28. Substrate 28 can then be assembled with other components, such as an identically-formed substrate, to produce an article, such as a tennis ball.

In the above example, substrate 28 can be inflated to a diameter, for example, twice that of its original size, which is, for practical purposes, the same as the diameter of the lower portion of mandrel 12, prior to flocking. The wall thickness of substrate 28 is typically only a few mils thick. Consequently, since the quantity of flock attached to the expanded substrate remains the same as when the substrate is contracted, but the surface area of the contracted substrate is only one-quarter that of the expanded substrate, it follows that the density of flock on the contracted substrate is four times that of the original flocking density. By controlling the expanded surface area of any substrate versus its unexpanded, or normal, surface area, any level of density increase over the best that can be accomplished through normal flocking technology can be achieved, up to the point that the contracted surface cannot accept any additional flock fibers. In as much as the highest flock densities rarely exceed fifteen percent of the theoretical flock density possible for a given flock length and denier, it is possible to increase the area of the expanded substrate by about six times, if the absolute maximum flock density is sought.

Figure 6:
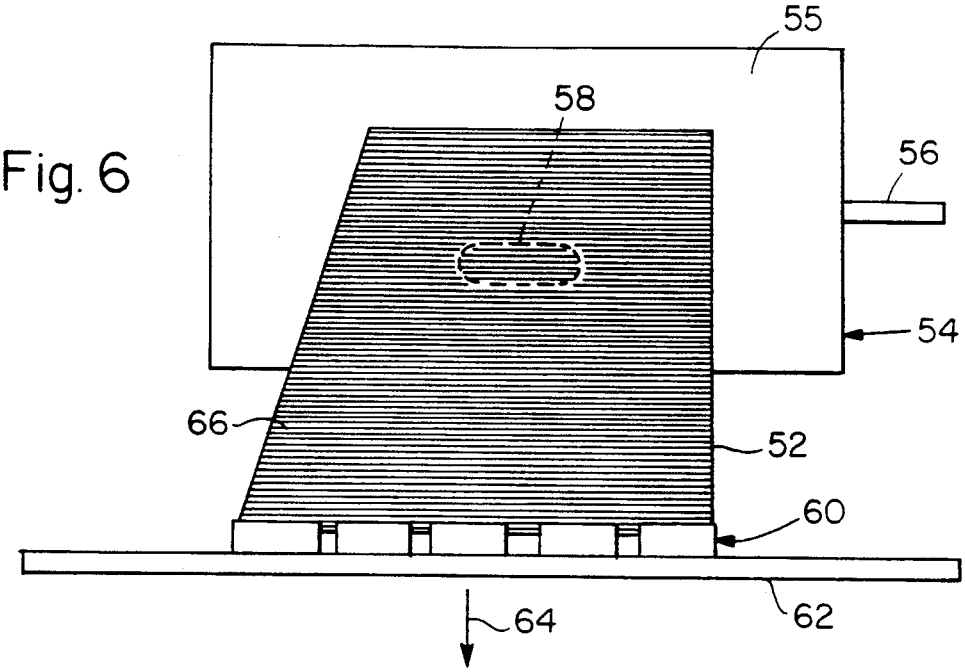
FIG. 6 is a schematic illustration of another embodiment of the invention, wherein an adhesive-coated, expandable substrate is partially supported by a vacuum table and partially supported by a series of clamps which can move along a movable track.

In another embodiment of the invention, shown in FIG. 6, a portion of a flexible and expandable polygon-shaped substrate 52, which is formed of a resilient material, is placed on vacuum table 54. A portion of substrate 52 is secured by drawing a vacuum between substrate 52 and surface 55 of vacuum table 54 through tube 56. In this example, portion 58 of substrate 52 is to be flocked at a higher density level than the immediate surrounding surface, together with that portion of substrate 52 which is not held by vacuum table 54. In this embodiment, portion 58 is not held down by suction but is supported by an oval-shaped piston, not shown, which can be raised through vacuum table 54. A lower edge of substrate 52 is secured by clamps 60 (five such clamps are depicted). Clamps 60 are designed to move along track 62. Track 62 and clamps 60 are also movable in a plane parallel to vacuum table 54, in a direction shown by arrow 64. Prior to moving track 62 in the direction indicated by arrow 64, an appropriate flock adhesive is disposed onto substrate 52. Alternatively, the adhesive can be disposed onto surface 66 after distending substrate 52 by moving track 62 and/or clamps 60.

Figure 7:
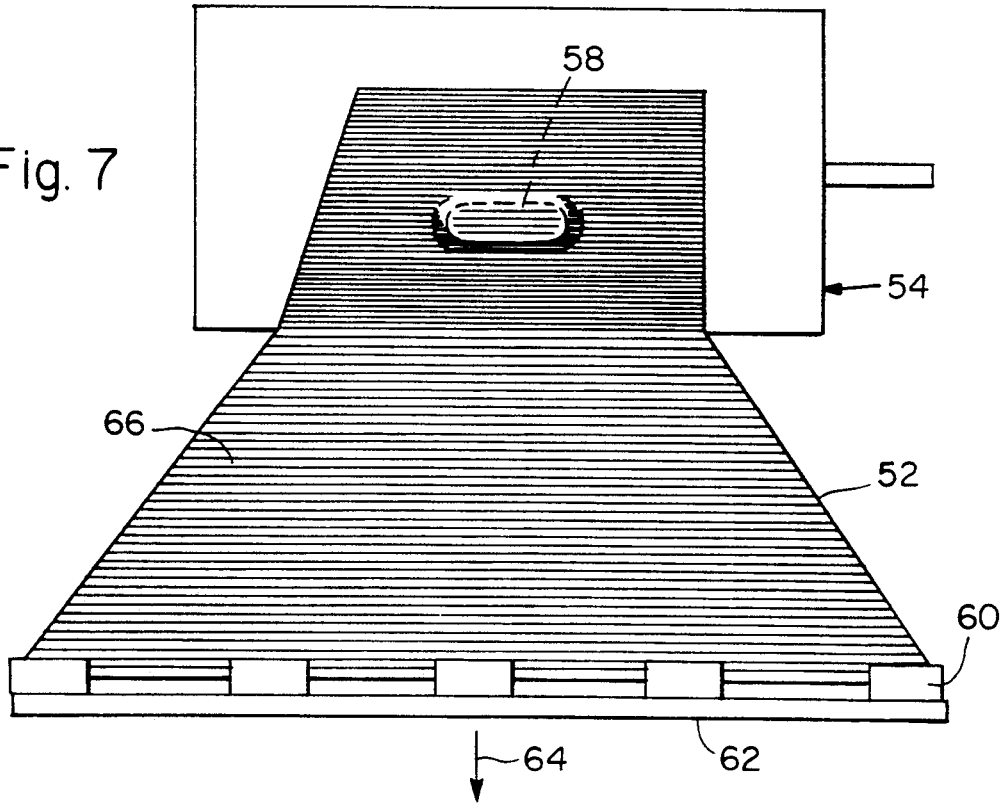
FIG. 7 is a schematic representation of the embodiment illustrated in FIG. 6 wherein a portion of the substrate is distended.

As can be seen in FIG. 7, track 62 is shown displaced from vacuum table 54 in the direction shown by arrow 64. Also, clamps 60 are shown in their extended position, having moved from being adjacent to each other to being equally spaced along the length of the track 62, while at all times maintaining a firm grip on the edge of substrate 52. Hence, substrate 52 is distended and surface 66 of the lower section of substrate 52, that is not held by vacuum table 54, is significantly increased.

Likewise, raising the oval piston beneath portion 58 expands the surface area of that portion of substrate 52, even as the surrounding area of substrate 52 is held by vacuum table 54. Thus, when the surface area of substrate 52 is flocked and track 62, clamps 60, and the oval piston beneath portion 58, are released and allowed to return to a relaxed state, as shown in FIG. 6, and the adhesive on substrate 52 is cured, the flock density over the surface of substrate 52 will vary. The gradient of flock density will vary with the amount a particular surface area was expanded prior to flocking. The highest densities will occur at raised portion 58 and at the lower portion of substrate 52 adjacent to the clamps. Flock density will decrease, in this example, more or less continuously and linearly until it reaches normal density at the portions of substrate 52 that are secured at vacuum table 54.

Figure 8:
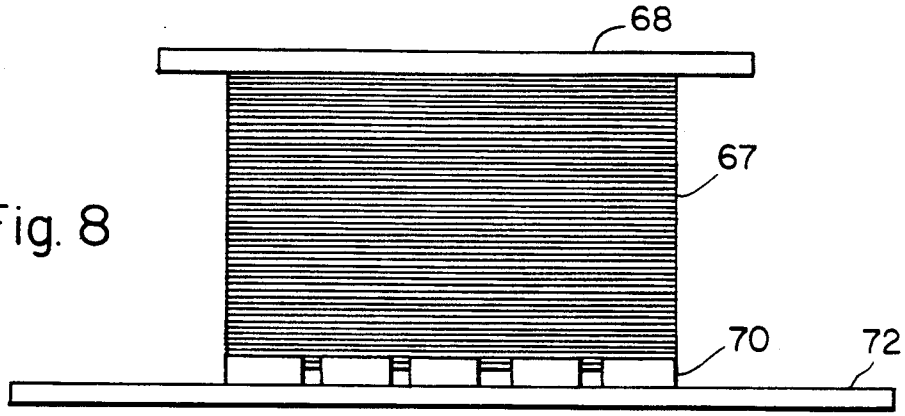
FIG. 8 is a schematic representation of another embodiment of the invention, wherein a top portion of an adhesive-coated expandable substrate is secured by a non-expandable clamp and a lower portion is secured by movable clamps, and wherein the substrate is in a relaxed position.

In still another embodiment of the invention, shown in FIG. 8, resilient substrate 67 is coated with an appropriate flock adhesive and secured by clamp 68 at a first end and by clamps 70 (five shown) at a second end. Clamps 70 can be moved along track 72. Substrate 67 is in a relaxed position.

Figure 9:
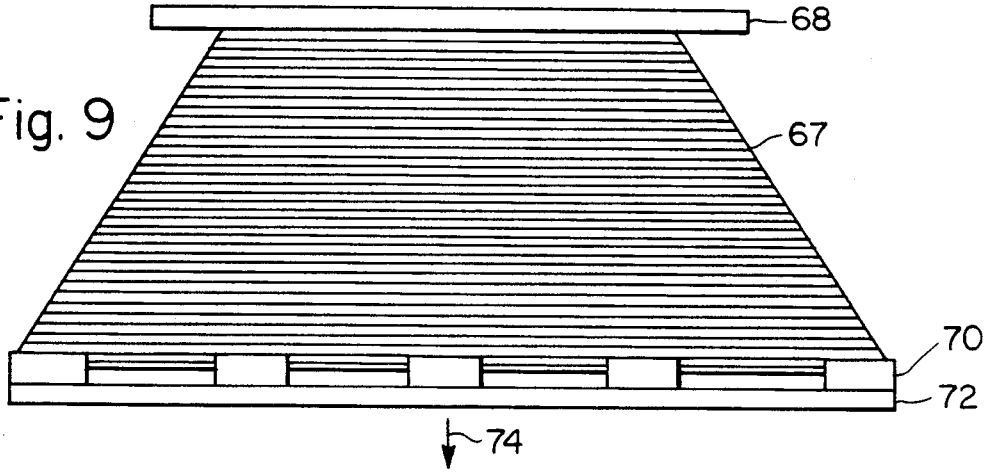
FIG. 9 is a schematic representation of the same substrate as is illustrated in FIG. 8, wherein the substrate has been distended asymmetrically.
Figure 10:
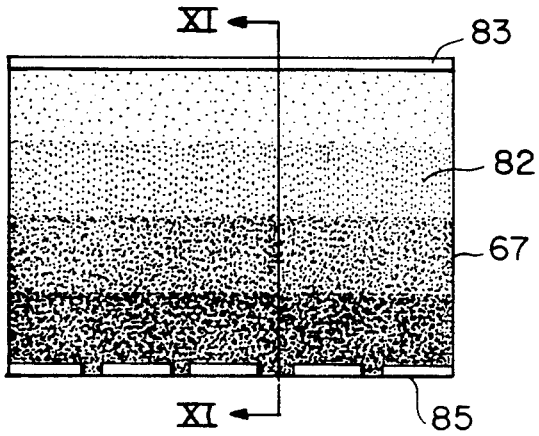
FIG. 10 is a schematic representation of the substrate illustrated in FIG. 9, and which has been allowed to return to its relaxed state, after having been previously flocked.
Figure 11:
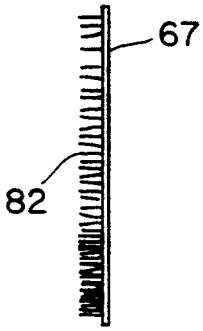
FIG. 11 is a section view of the flocked substrate illustrated in FIG. 10, taken along line XI—XI.

Substrate 67 is then distended in two directions, as shown in FIG. 9: being pulled down in the direction of arrow 74 and in its width by clamps 70, which have moved along track 72. The portion of substrate 67 held by clamp 68 is not distended, thereby causing a continually increasing gradient of distention from the first end to the second end. Substrate 67 is then flocked and subsequently released, thereby allowing substrate 67 to relax and return to its normal shape, as shown in FIG. 10. The flock on substrate 67 consequently has a gradient of density, as shown in FIG. 10, which increases from the first end to the second end. The increase in flock density is indicated by an increased gradient of shading. Areas 83 and 85, which were covered by clamps during flocking, remain unflocked. The density gradient of flock is also shown in FIG. 11. The adhesive on substrate 67 is then cured by a suitable method.

Figure 12:
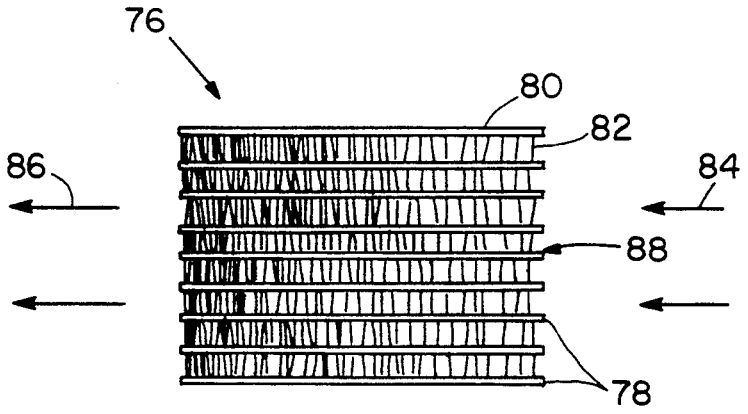
FIG. 12 is a section view of a filter of the present invention, including eight of the flocked substrates illustrated in FIG. 11 in a stacked arrangement.

In still another embodiment of the invention, shown in FIG. 12, filter 76 includes a series of flocked substrates 78. In this case, eight substrates 78 are depicted, which consist of eight of the structures shown in FIG. 11. Substrates 78 are stacked to form filter 76 with unflocked substrate 80 placed adjacent to flock 82, which is otherwise exposed.

In assembling filter 76, all surfaces of substrates 78 which will touch the ends of flock 82 are coated with adhesive so that flock 82 is anchored at both ends throughout the filter structure. To add strength to this physical structure, all membranes can be first adhered to other, structurally stiff substrates, prior to being stacked. High velocity air or other fluids entering the filter in the direction of arrows 84 and exiting in the direction of arrows 86, will not deform or bend the flock, making cells formed by the multitude of fibers of flock 82 and flocked substrates 78, and substrate 80, rigid and capable of trapping contaminants of the fluid stream.

Larger particles are trapped at entrance end 88 of filter 76 and smaller particles are trapped within filter 76, depending on their size and the size of the filter cells generated by the progressively higher-entity flock concentrations. In the event a finer filter medium is desired, it is possible to place two flocked membranes face-to-face, with the flock from each membrane meshing with the flock from the other membrane, resulting in effectively doubling the flock fiber concentration, and a greatly increased fine particle trapping capability.

Figure 13:
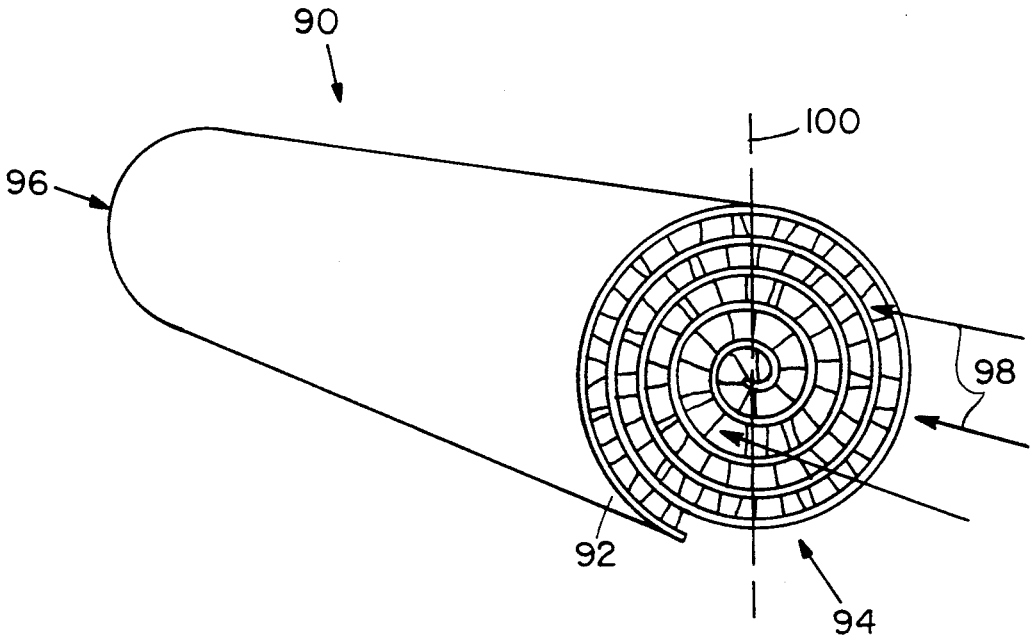
FIG. 13 is a perspective view of another embodiment of a filter of the invention.

In another embodiment of filter 90 of the present invention, shown in FIG. 13, a cylindrical form of filter 90 is generated by utilizing a single flocked substrate 92, having a continuous gradient of flock density. Adhesive is disposed on an unflocked side of substrate 92 and then rolled, so that unanchored flock ends adhere to the newly applied adhesive. By rolling the membrane around a vertical axis, the relatively low density of fibers are at first end 94 of filter 90. A relatively high density of fibers is located at second end 96 of filter 90. Fluid flows through filter 90 in a direction indicated by arrows 98. A cross-sectional view of the filter 90, taken along line 100, would appear similar to the schematic representation shown in FIG. 12.

Another application of this invention is manufacture of abrasive sanding pads or belts, which can be produced by utilizing aramid or similar high-strength, inherently abrasive fibers, or abrasive-coated polyamide flock fibers. Such pads are capable of sanding concave or similarly deep-grooved surfaces. Abrasive-coated fibers are extraordinarily difficult to flock at high density levels because of the high frictional forces between adjacent fibers, preventing high packing densities under normal flocking conditions. Because of the high pressure points developed in either hand or machine sanding of complex shapes, normal density flocked pads are not very useful or practical, because of the matting of the fibers that takes place when even relatively light pressure is applied to a normal-density flocked surface. Furthermore, flock lengths for these applications are preferably longer than eighty mils, perhaps closer to a quarter of an inch: a length which is difficult to flock, even with high-denier flock. By utilizing a process similar to that described above, and either retaining or eliminating the variable density mechanism, i.e., differential elongation of the membrane prior to flocking, a sanding pad, which can be attached to a sanding block or adhered to a belt, results. The appearance of this sanding pad is similar to FIG. 11, but with longer fibers of flock 82, (mentioned above), than would be used for most other applications. In use, the lower density sanding pads (but still above the densities of traditionally flocked substrates) would be used in deep crevice areas, such as in tightly-grooved furniture legs, with the higher density pads more beneficently used in more gradually turned or sculptured surfaces.

This invention also makes possible desirable and useful new applications in the footwear trade. There have been significant efforts to modify the traditional leather or rubber sole and heel, primarily for reasons of comfort. Carpets have long been used as walking surfaces, for reasons quite independent of their aesthetic or thermal effects. They provide or enhance a quiet, soft and pleasingly comfortable walking environment, regardless of the footwear one wears. Utilizing a traditional carpet surface as the sole of a shoe might initially provide the comfort of walking on a carpeted surface even while walking on a hard surface, but, in general, will have an unacceptably short lifetime. The use of a high-density-flocked membrane, having two to three times higher density than is normally available, applied as the sole of a shoe or sneaker, will provide the cushiness and flexibility of a carpet. Furthermore, a three time increase in density implies (remembering that at normal flock densities, only one-sixth or less of the maximum theoretical flock possible is applied) an overall density of the sole structure approximately equal to one-half the density of a solid sole made of the same material as the flock. In other words, 80 mil long nylon flock at three times normal density levels should have the abrasion resistance of a 40 mil solid nylon sole, a practical wear surface which will still have the give or cushiness of a carpet.

Where exceptional wear characteristics are desired, aramid or similar fibers can be used, including the encapsulation of the fibers at selected areas, such as the toe and heel areas, using rubber or rubber-like materials, further enhancing the wear ability of the sole. A soft, long-wearing and light-weight sole (and heel) can be made by encapsulating the complete aramid or nylon flocked sole and heel, with a relatively light-weight, perhaps foamed, urethane rubber, which will further support the fibers from bending and breaking, but will, in fact, support then so as to wear along their lengths. The thickness of the sole (and its weight), for a given wear resistance, can be modified by choice of the type of fibers used, which can, for example, even be a mixture of aramid and nylon fibers, and by the density of the fibers on the substrate, all of which can be well controlled, including the easy repair or replacement of the sole to provide different tactile, friction or wear characteristics.

Where high perspiration levels are prevalent, as in sneakers, an inner sole, constructed much like the soles described above, but preferably using a high density of finer (lower denier) fibers, will provide a soft feeling for the foot, not be materially or permanently crushed by the applied weight of the person, and provide an inherent mechanism for the circulation of air and removal of perspiration.

High-density-flocked membranes may be used in place of the decorative and functional leather strips typically stitched to the uppers of a pair of sneakers. High-density flocked sections may be conveniently adhesively bonded, eliminating the very costly stitching operations for adhering leather, provide a depth of brilliance of color unattainable in leather dyeing, similar to velour (when desired), and provide the abrasion resistance required for various portions of the sneakers, from toe to heel on the uppers, which is not possible with normal-density flocked substrates.

It is to be understood that, alternatively, other methods can be employed to distend the substrate, such as by use of molds. Also, it is to be understood that, rather than distending a resilient substrate and then allowing it to relax after disposing the flock onto a surface of the substrate, a substrate can be employed which can significantly decrease in size upon exposure to sufficient conditions. For example, a polymer substrate, such as a heat-shrinkable tube, can be employed which, upon exposure to sufficient heat, shrinks, whereby the surface area of the substrate diminishes significantly. A particular material disposed on the surface and which adheres to the surface will thereby significantly increase in density.

EQUIVALENTS

Although preferred embodiments of this invention have been specifically described and illustrated herein, it will be appreciated that many modifications and variations in the present invention are possible in light of the above teachings, within the purview of the following claims, without departing from the spirit and scope of the invention.

I claim:

1. A method for increasing the density of a particulate substance adhering to a substrate, wherein the substrate is sufficiently resilient to distension to cause the substrate to thereafter relax and thereby cause a surface of the substrate to diminish, comprising the steps of:

a) disposing the substrate on a support;

b) directing a material between the substrate and the support to thereby distend the substrate in an amount sufficient to allow the surface area on which an adhesive is disposed to diminish following release of the substrate by discharging the material from between the substrate and the support;

c) disposing the particulate substance onto the substrate surface; and d) discharging the material from between the substrate and the support, whereby the substrate relaxes, thereby diminishing the substrate surface area and consequently increasing the density of the particulate substance on the substrate.

2. A method of claim 1, wherein the material is a liquid.

3. A method of claim 1, wherein the material is a gas.

4. A method of claim 3 further including the step of forming the substrate, wherein the substrate is formed by:

a) at least partially immersing the support in a fluid substrate precursor, whereby the support is at least partially coated with the fluid substrate precursor; and b) exposing the support and the fluid substrate precursor coated onto the support to conditions sufficient to cause the fluid substrate precursor to form the substrate.

5. A method of claim 4 wherein the fluid substrate precursor includes a latex.

6. A method of claim 5 wherein the conditions sufficient to cause the fluid substrate precursor to form the substrate include exposure of said fluid substrate precursor to a coagulant which causes the latex to substantially coagulate on the support.

7. A method of claim 6 wherein the adhesive is disposed on the substrate by at least partially immersing the substrate in a fluid adhesive, whereby at least a portion of the fluid adhesive adheres to the substrate surface.

8. A method of claim 7 further including the step of spinning the substrate and support while the substrate is at least partially immersed in the fluid adhesive, the axis of rotation of the substrate and the support being at an acute angle to the surface of the fluid adhesive bath, thereby forming a coat of the adhesive over at least a portion of the substrate.

9. A method of claim 8 wherein the particulate substance is a flock of fibers.

10. A method of claim 9 wherein the flock is deposited on the adhesive by electrostatic deposition.

11. A method of claim 10 wherein the substrate has a shape which is substantially hemispherical.

12. A method for increasing the density of a particulate substance adhering to a substrate, wherein the substrate is sufficiently resilient to distension to cause the substrate to thereafter relax and thereby cause the surface area of the substrate to diminish, comprising the steps of:

a) supporting a first edge of the substrate with a first support;

b) supporting a second edge of the substrate with a second support, wherein said second support is movable relative to the first support, and wherein said second support is extendable along the second edge of the substrate;

c) disposing an adhesive onto the substrate;

d) moving the second support relative to the first support, thereby distending at least a portion of the substrate, the substrate being distended in an amount sufficient to cause the surface area on which the adhesive is disposed to diminish following release of the substrate;

e) extending the second support to elongate the second edge of the substrate;

f) disposing the particulate substance onto the adhesive disposed on the substrate whereby the particulate substance adheres to the substrate; and g) releasing the substrate after disposing the particulate substance onto the adhesive, whereby the substrate relaxes, thereby diminishing the surface area of the substrate and consequently increasing the density of the particulate substance on the substrate.

13. A method of claim 12 wherein moving the second support relative to the first support and expanding the second support forms a gradient of distension of the substrate, whereby the particulate substance on the adhesive, following relaxation of the substrate, has a continuous gradient of density which corresponds to the gradient of distension of the substrate during deposition of the particulate substance onto the adhesive.

14. A system for increasing the density of a particulate substance adhering to a resilient substrate, comprising;

a) a support, defining a conduit extending therethrough;

b) means for disposing the resilient substrate onto the support, whereby one end of the conduit is covered by the resilient substrate in a relaxed position;

c) means for directing a fluid material through the conduit in between the resilient substrate and the support to cause the resilient substrate to move from the relaxed position to a distended position;

d) means for adhering the particulate substance onto the resilient substrate when said resilient substrate is in the distended position; and e) means for releasing the fluid material from between the support and the resilient substrate, thereby allowing the density of the particulate substance bound to the resilient substrate to significantly increase during movement of the resilient substrate from the distended position to the relaxed position.

15. A system for increasing the density of a particulate substance adhering to a resilient substrate, comprising:

a) a first supporting means for supporting a first edge of the substrate;

b) a second supporting means for supporting a second edge of the substrate, wherein the second supporting means is movable from a first position to a second position relative to the first supporting means to thereby distend the substrate, and wherein the second supporting means is extendable along the second edge of the substrate, to thereby elongate the second edge of the substrate; and c) means for adhering the particulate substance onto the substrate while the substrate is in the elongated, distended position, whereby release of the substrate increases the density of the particulate substance adhering to the substrate.

16. A system of claim 15 wherein the first supporting means is extendable along the first edge of the substrate, to thereby elongate the first edge of said substrate.

* * * * *